US006907206B2

(12) United States Patent
Hattori et al.

(10) Patent No.: US 6,907,206 B2
(45) Date of Patent: Jun. 14, 2005

(54) ASSEMBLY STRUCTURE FOR IMAGE FORMING APPARATUS

(75) Inventors: Yoshiteru Hattori, Bisai (JP); Hideo Yoshihara, Dongguan (CN); Shusaku Tsusaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/658,290

(22) Filed: Sep. 10, 2003

(65) Prior Publication Data

US 2004/0131378 A1 Jul. 8, 2004

(30) Foreign Application Priority Data

Nov. 8, 2002 (JP) ..... 2002-325299

(51) Int. Cl.[7] ..... G03G 15/00; B41J 29/00

(52) U.S. Cl. ..... 399/90; 399/88; 399/92; 399/107; 399/111

(58) Field of Search ..... 399/107, 90, 111, 399/88, 37, 91, 92; 347/138, 152, 108; 358/500–503, 400, 401, 296

(56) References Cited

U.S. PATENT DOCUMENTS

| | | | | |
|---|---|---|---|---|
| 5,561,499 A | * | 10/1996 | Setoriyama | 399/111 |
| 5,887,226 A | | 3/1999 | Taki | 399/92 |
| 5,907,745 A | * | 5/1999 | Azuma et al. | 399/92 |
| 6,778,197 B2 | * | 8/2004 | Yamanaka | 399/90 X |
| 2004/0096229 A1 | * | 5/2004 | Yoshihara et al. | 399/33 |

FOREIGN PATENT DOCUMENTS

| | | | |
|---|---|---|---|
| EP | 0 240 337 A2 | | 10/1987 |
| EP | 1 089 142 A2 | | 4/2001 |
| JP | A-8-6336 | | 1/1996 |
| JP | 08-006472 | * | 1/1996 |
| JP | A-8-101547 | | 4/1996 |
| JP | A 8-139834 | | 5/1996 |
| JP | A 10-143053 | | 5/1998 |
| JP | A 11-341203 | | 12/1999 |
| JP | A-2000-98859 | | 4/2000 |
| JP | A-2001-156964 | | 6/2001 |
| JP | 2001-290323 | * | 10/2001 |
| JP | A-2002-185154 | | 6/2002 |

* cited by examiner

*Primary Examiner*—Sophia S. Chen
(74) *Attorney, Agent, or Firm*—Oliff & Berridge PLC

(57) ABSTRACT

An image forming apparatus includes a body frame having left and right side frame parts and a partition wall frame part that is placed below a sheet path passing through an image forming unit in a process unit. The process unit and a drive transmission system frame having a drive mechanism for transporting sheets are placed in a longitudinal direction on an outer face of the left side frame part. A high voltage power board, a low voltage power board, and an engine control board for the drive mechanism are fixedly placed horizontally on a lower face side of the partition wall frame part. A main control board is placed substantially vertically so as to become adjacent to the drive transmission system frame and extend along the outer face of the left side frame part. The boards and parts are connected by connection lines.

10 Claims, 14 Drawing Sheets

ASSEMBLY STRUCTURE FOR IMAGE FORMING APPARATUS

BACKGROUND OF THE INVENTION

1. Field of the Invention

The present invention relates to an image forming apparatus such as a printer, a copier, or a facsimile apparatus, and more particularly to attaching positions and attitudes of circuit boards in an image forming apparatus.

2. Description of the Related Art

JP-A-10-143053 and JP-A-11-341203 disclose an electrophotographic image forming apparatus such as a laser printer or a laser facsimile in which an image forming unit is disposed in an upper side of a body frame and a plurality of circuit boards (control boards) are placed horizontally in a lower face side of the body frame.

According to these related arts, as the number of circuit boards increases, the plan view area of the body frame must be enlarged to house the circuit boards. This causes an increase in size of the image forming apparatus.

JP-A-10-143053 and JP-A-11-341203 further disclose that a low voltage power board, a high voltage power board, and a main control board are placed horizontally in the lower part of a main frame and a space that is isolated from a sheet path space through which a printing medium passes is defined at the rear of the main frame for placing an NCU board in an upright state. The NCU board is placed so as to become, in a plan view, orthogonal to a drive system unit placed on one side of the main frame.

In these related arts, a laser scanner unit as an exposure unit is placed below a process unit as an image forming unit and thus a wiring between the boards and the laser scanner unit can be shortened. However, in the case where the laser scanner unit, the image forming unit, and the main control board are placed from above, a harness for connecting the main control board and the laser scanner unit lengthens and a high-frequency signal is sent to the harness. Thus, noise is easily produced from the harness and noise occurring from actuators of solenoids, motors, etc., is easily picked up by the harness. If noise is thus picked up, a formed image easily becomes irregular.

In the case where the main control board is positioned in the lower part of the main frame, the harness between the main control board and a key switch portion positioned in the upper part of the image forming apparatus lengthens. Further, in a complex image forming apparatus provided by adding a facsimile function and an original read scanner function to a printer, an original read section is generally placed on the top of the apparatus and thus the harness for transmitting a signal from a line CCD image pickup device (image sensor), etc., of the original read section to the main control board lengthens and electric noise easily gets mixed in at the middle of the harness.

SUMMARY OF THE INVENTION

The present invention has been made to solve the above problems, and therefore an object of the invention to provide an image forming apparatus compact in size, in which harnesses can be shortened.

According to an aspect of the invention, there is provided an image forming apparatus including: first and second side frames as a pair of left and right frames extending in a substantially vertical direction; an image forming unit disposed between the first and second side frames for developing an electrostatic latent image formed on an electrostatic latent image support, transferring the latent image to a recording medium, and forming an image on the recording medium; an exposure unit disposed above the image forming unit for exposing the electrostatic latent image support to light for forming an electrostatic latent image; a main control board placed substantially vertically on the side of the first side frame for outputting a light exposure signal to the exposure unit in accordance with image data and outputting control signals to the image forming unit and the exposure unit; a power board placed substantially horizontally below the image forming unit on the side of the second side frame; and an engine control board placed substantially horizontally below the image forming unit for outputting a drive signal to drive sources of the image forming unit and the exposure unit in accordance with a control signal from the main control board, the engine control board placed closer to the first side frame than the power board.

According to the configuration, the image forming apparatus can be made compact in size and connection lines to the boards or the machines such as drive sources can be shortened. Particularly, the main control board is placed substantially vertically and thus the connection line between the exposure unit driven at a high frequency and the main control board can be shortened and noise can be prevented from occurring and irregularity in an image caused by noise can be prevented.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
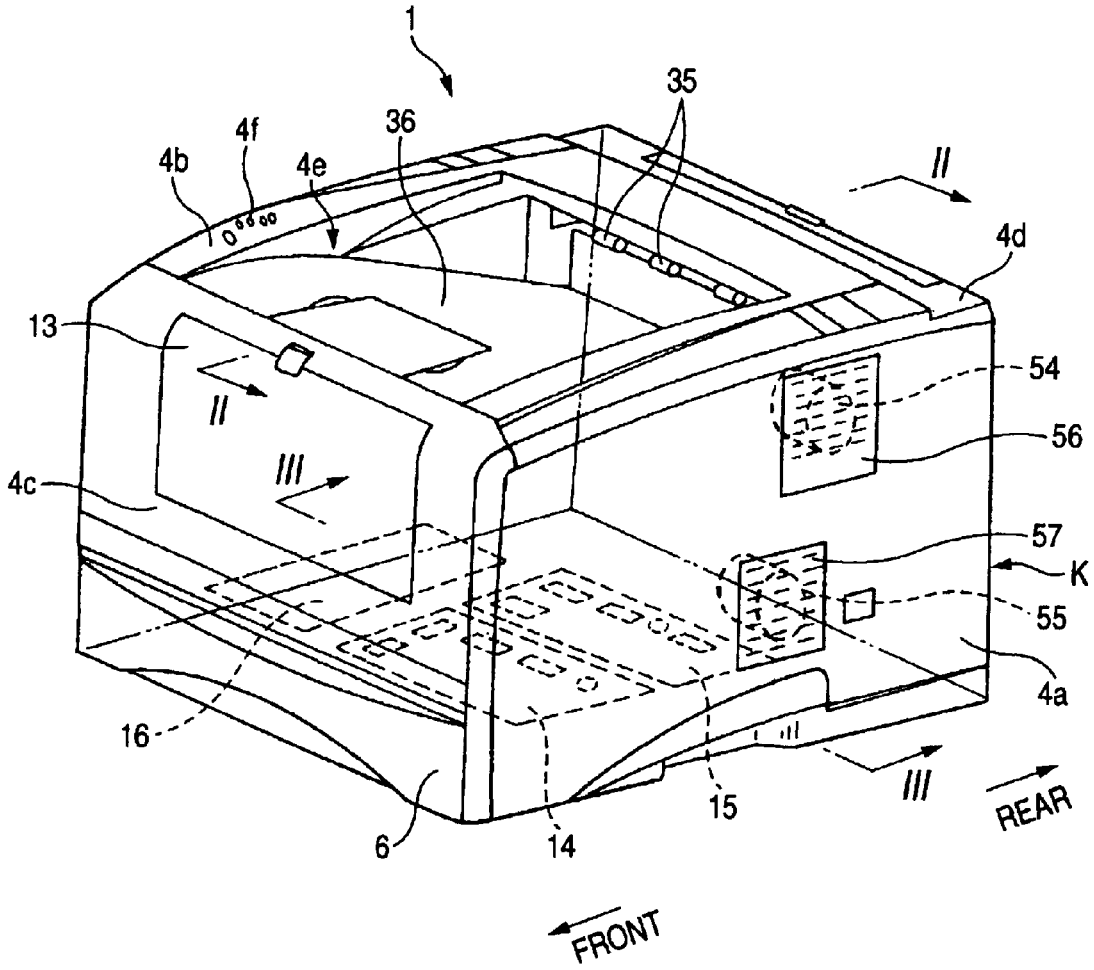
FIG. 1 is a schematic perspective view showing a laser printer as an image forming apparatus according to an embodiment of the invention.
Figure 2:
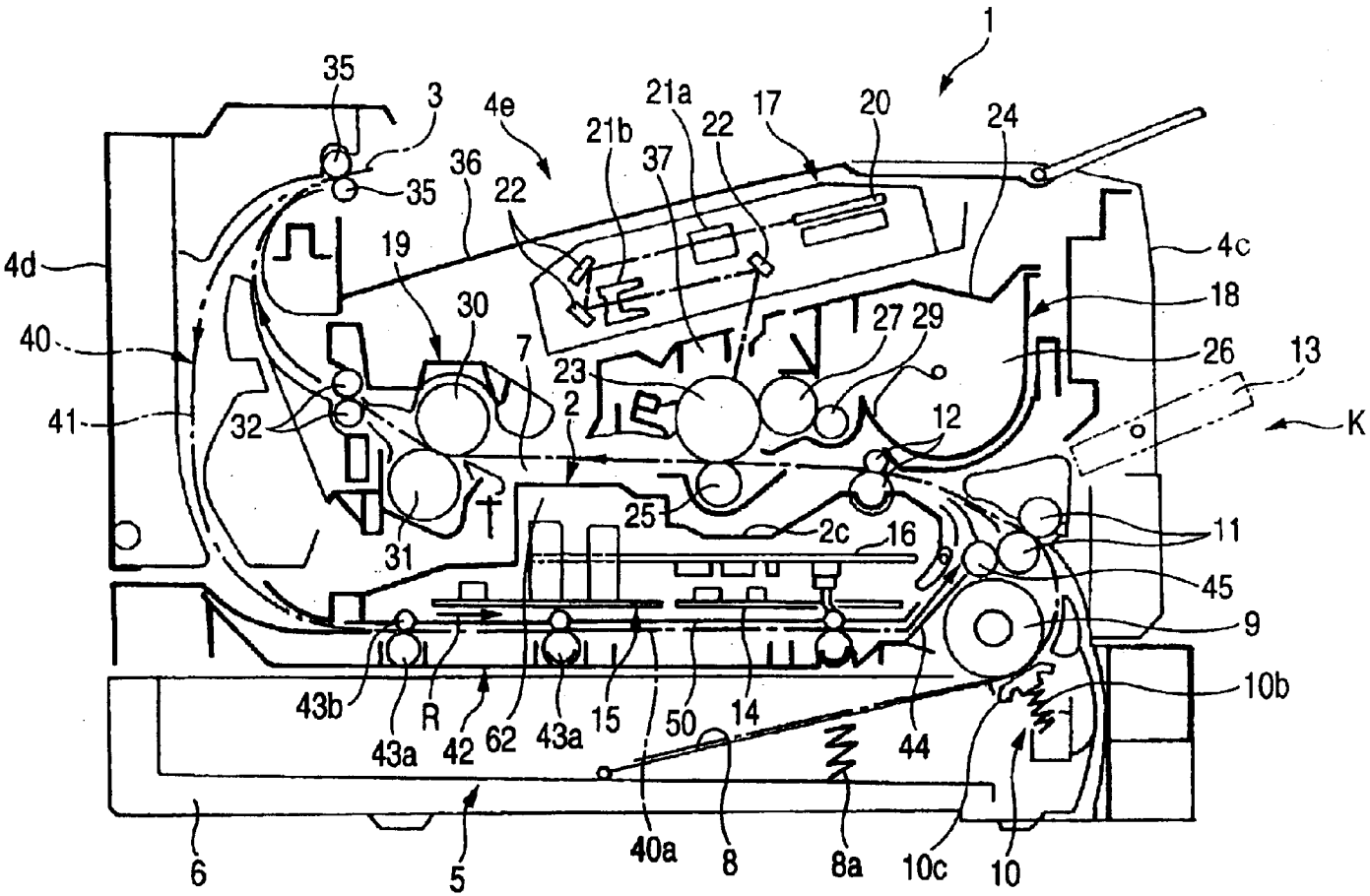
FIG. 2 is a sectional view taken along line II—II in FIG. 1.
Figure 3:
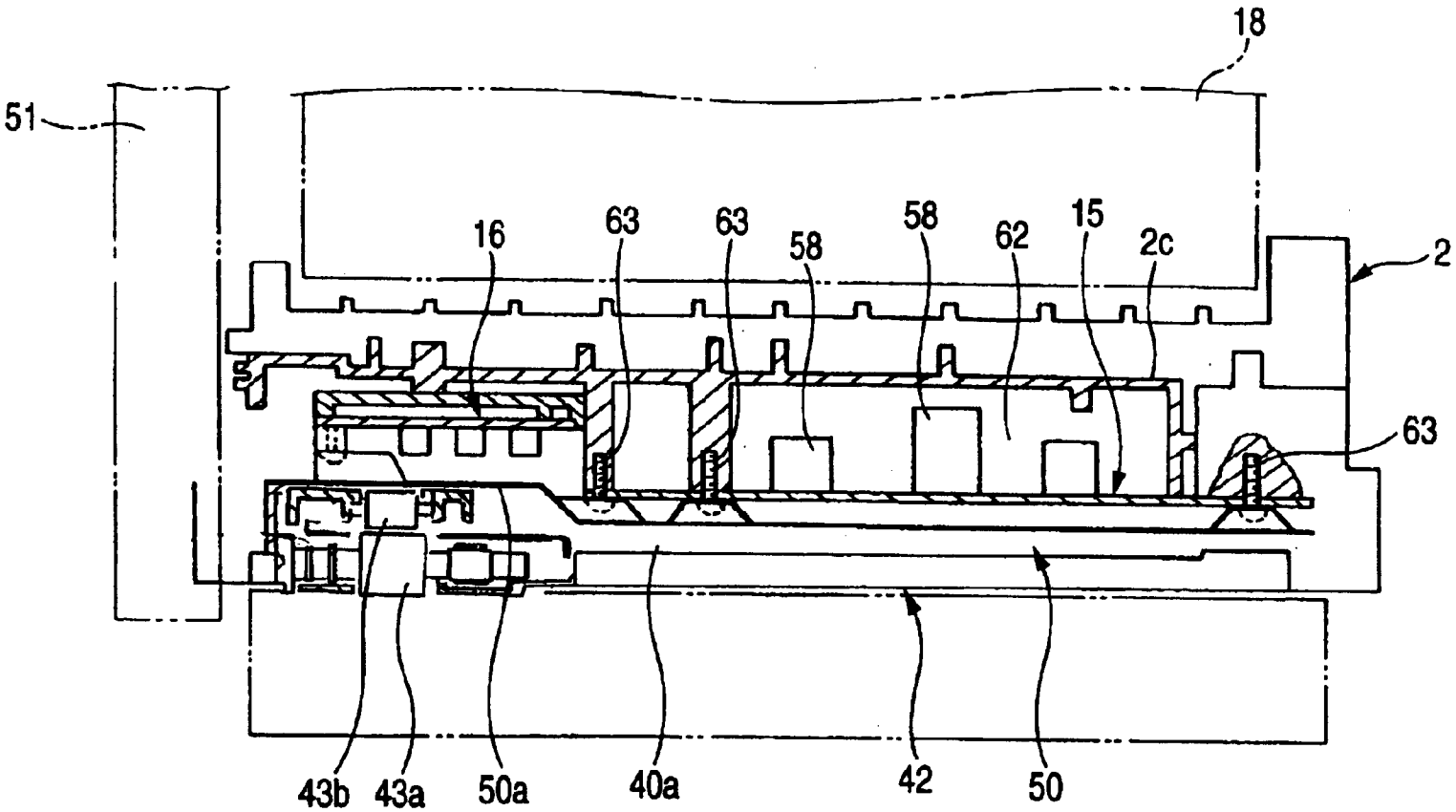
FIG. 3 is a sectional view taken along line III—III in FIG. 1.
Figure 4:
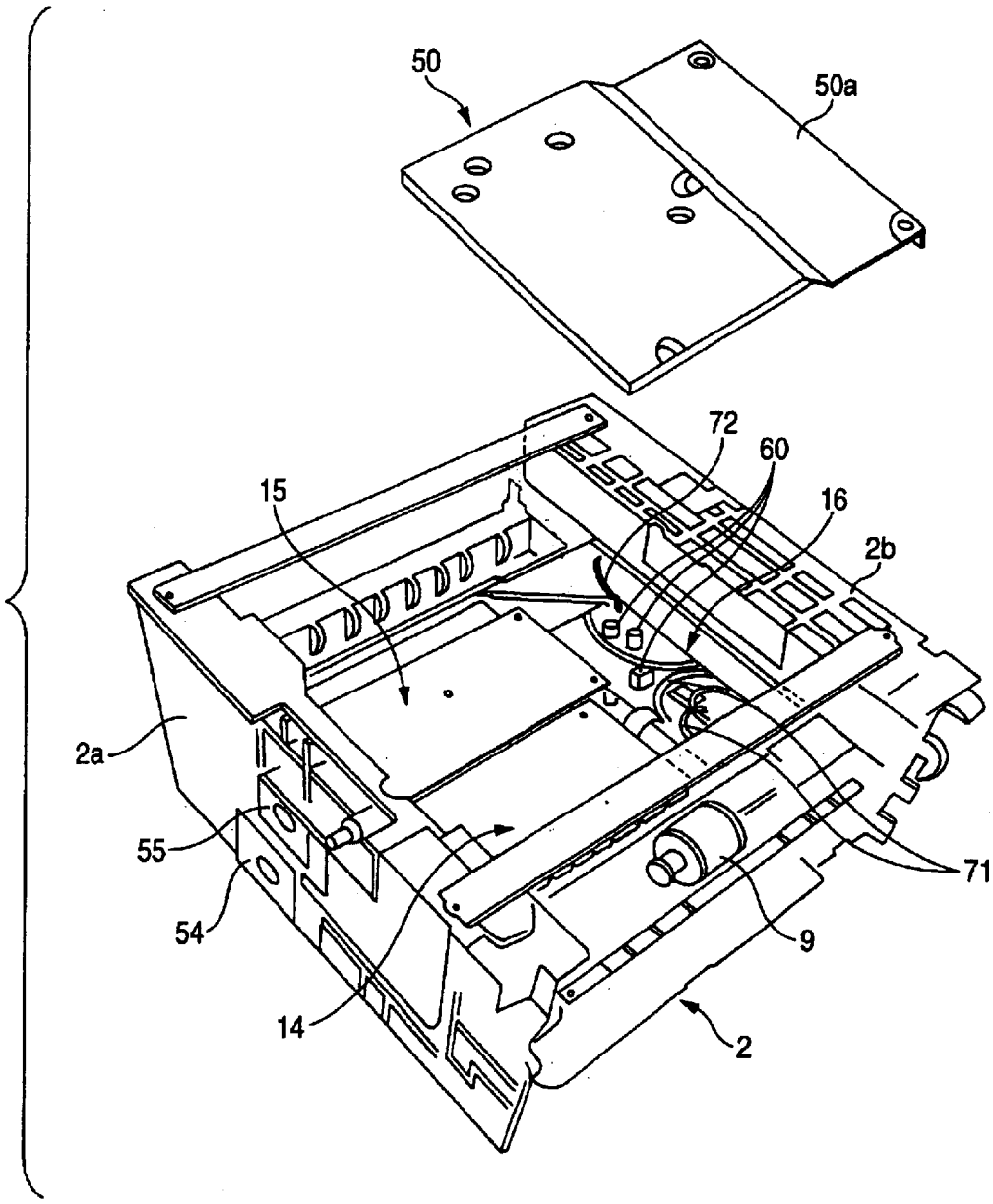
FIG. 4 is a perspective view showing a process of attaching control boards while a body frame is turned upside down.
Figure 5:
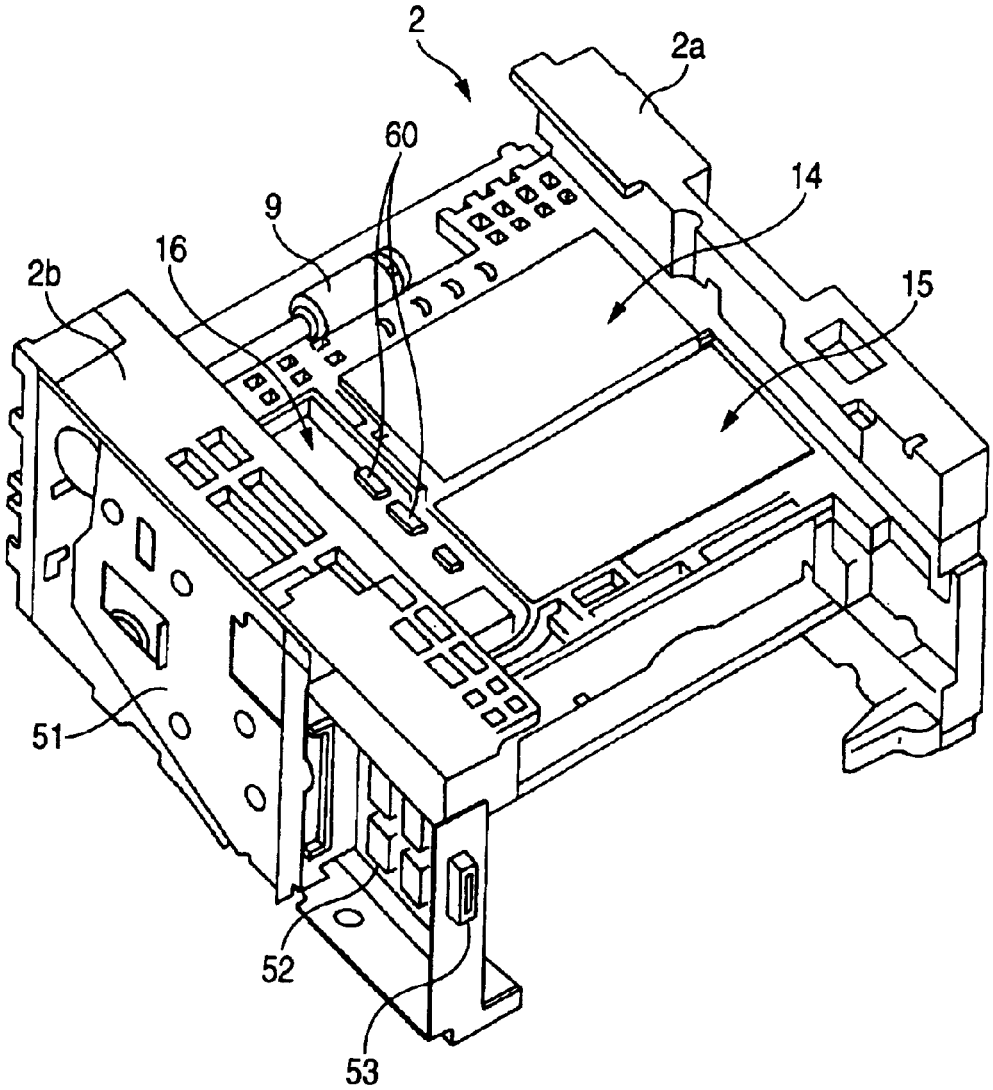
FIG. 5 is another perspective view showing a process of attaching control boards while a body frame is turned upside down.
Figure 6:
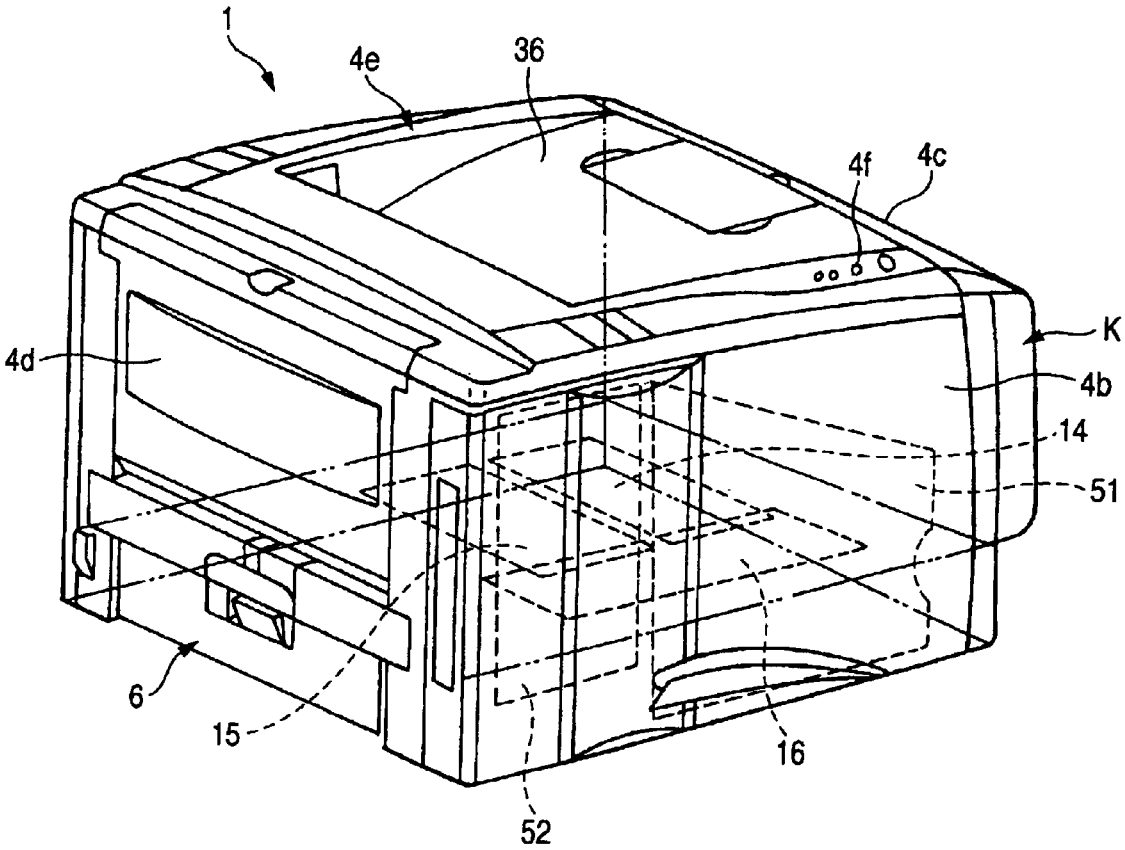
FIG. 6 is a schematic perspective view showing the laser printer viewed from a different direction.

An embodiment of the invention will be described with reference to the accompanying drawings. FIG. 1 is a schematic perspective view showing a laser printer as an image forming apparatus according to an embodiment of the invention. In FIG. 1, an insertion side of a sheet feed tray (body front side) is shown as the left front. FIG. 2 is a sectional view taken along line II—II in FIG. 1. FIG. 3 is a sectional view taken along line III—III in FIG. 1. FIG. 4 is a perspective view of the laser printer turned upside down, when viewed from one direction. FIG. 5 is a perspective view of the laser printer turned upside down, when viewed from another direction. FIG. 6 is another schematic perspective view showing the laser printer. In FIG. 6, the rear of the body is shown as the left front.

FIG. 1 is a perspective view of a laser printer 1. In this embodiment, an insertion side of a sheet feed tray 6 described later is called a front side, and the opposite side is called a rear side of the laser printer 1. Side cover members 4*a* and 4*b* as decorative covers are detachably attached to the right and left outer sides of a body frame 2 made of a synthetic resin by screws (not shown) when viewed from the front of the laser printer 1 (when viewed from the left in FIG. 1). A front cover member 4*c* and a rear cover member 4*d* as decorative covers are detachably attached to the front and rear outer sides of the body frame 2 by screws (not shown). Further, a top cover member 4*e* as a decorative cover which has a sheet discharging tray 36, an operation section, etc., is detachably attached to the top of the body frame 2 by screws (not shown). These cover members constitute a body case K.

Each of the side cover members 4*a* and 4*b*, the front and rear cover members 4*c* and 4*d*, and the top cover member 4*e* is also made of a synthetic resin.

As shown in FIGS. 2, 3, 4, and 5, the body frame 2 includes right and left side frame parts 2*a* and 2*b* to which the right and left side cover members 4*a* and 4*b* are attached and a partition wall frame part 2*c* for partitioning the body frame 2 to upper and lower parts at a vertical intermediate position of the inner faces of the side frame parts 2*a* and 2*b*. These frame parts 2*a*, 2*b* and 2*c* are integrally formed in one piece. Control boards 14, 15, and 16 are placed in a lower face side of the partition wall frame part 2*c* as described later, and lower faces of the control boards are covered with a bottom cover member 50 that is a base plate made of a metal plate, etc. An operation panel 4*f* is provided on the top of the left cover member 4*b* as shown in FIG. 1.

A sheet feeder 5 for feeding sheets 3 (cut sheets) as recording mediums is placed below the bottom cover member 50. Placed above the partition wall frame part 2*c* are a process unit 18 as an image forming unit configured to form a predetermined image on a fed sheet 3, a scanner unit 17, a fixer 19 as a fixing unit, and the like.

The sheet feeder 5 includes the sheet feed tray 6 detachably installed in the body frame 2, a sheet pressing plate 8 disposed in the sheet feed tray 6, a D-shaped sheet feeding roller 9 disposed above one end portion of the sheet feed tray 6 for intermittently making one rotation, and a separating member 10.

A transport path 7 for the sheet 3 elongating from the sheet feeding roller 9 to an image forming position (a contact area between a photosensitive drum 23 and a transfer roller 25, i.e., a transfer position where a toner image on the photosensitive drum 23 is transferred to the sheet 3) is defined between an upper face of the partition wall frame part 2*c* and the bottom of a case of the process unit 18, and between the right and left side frame parts 2*a* and 2*b* in the body frame 2, as shown in FIG. 2. On the transport path 7 as the sheet path, a transport roller pair 11 and a registration roller pair 12 placed just before the image forming position are disposed at an adequate interval downstream from the sheet feeding roller 9 in a transport direction.

The sheets 3 are stacked on the sheet pressing plate 8. The sheet pressing plate 8 is swingably supported at an end portion which is remote from the sheet feeding roller 9, thereby enabling an end portion close to the roller to be vertically movable. The sheet pressing plate is upward urged from a back side by a spring 8*a*. The sheet feeding roller 9 and the separating member 10 are placed so as to be opposed to each other. The separating member 10 includes a separating pad (not shown) that is formed by a member having a large coefficient of friction. The separating pad is pressed toward the sheet feeding roller 9 by a spring 10*b* disposed on a back side of a pad support member 10*c* of the separating member 10.

The separating pad and the sheet feeding roller 9 are formed to be shorter in width in a direction perpendicular to the transport direction of the sheet 3, than the sheet 3, and placed so as to be in contact only with an approximately central area of the sheet 3 in the width direction during a feeding process.

Among the sheets 3 stacked on the sheet pressing plate 8, the uppermost sheet 3 is pressed against the sheet feeding roller 9 and is separated by the separating member 10 as the sheet feeding roller 9 rotates for feeding one sheet at a time. The fed sheet 3 is delivered to the transport roller pair 11 and the registration roller pair 12 in order and the leading end of the sheet 3 is subjected to registration. The sheet 3 is then delivered to the image forming position.

A manual tray 13 for manually supplying the sheet 3 is foldably placed above the transport roller pair 11 (downstream in the transport direction: in the front cover member 4*c* of the body frame 2 at a position above the sheet feeder 5). (See FIGS. 1 and 2.)

Figure 8:
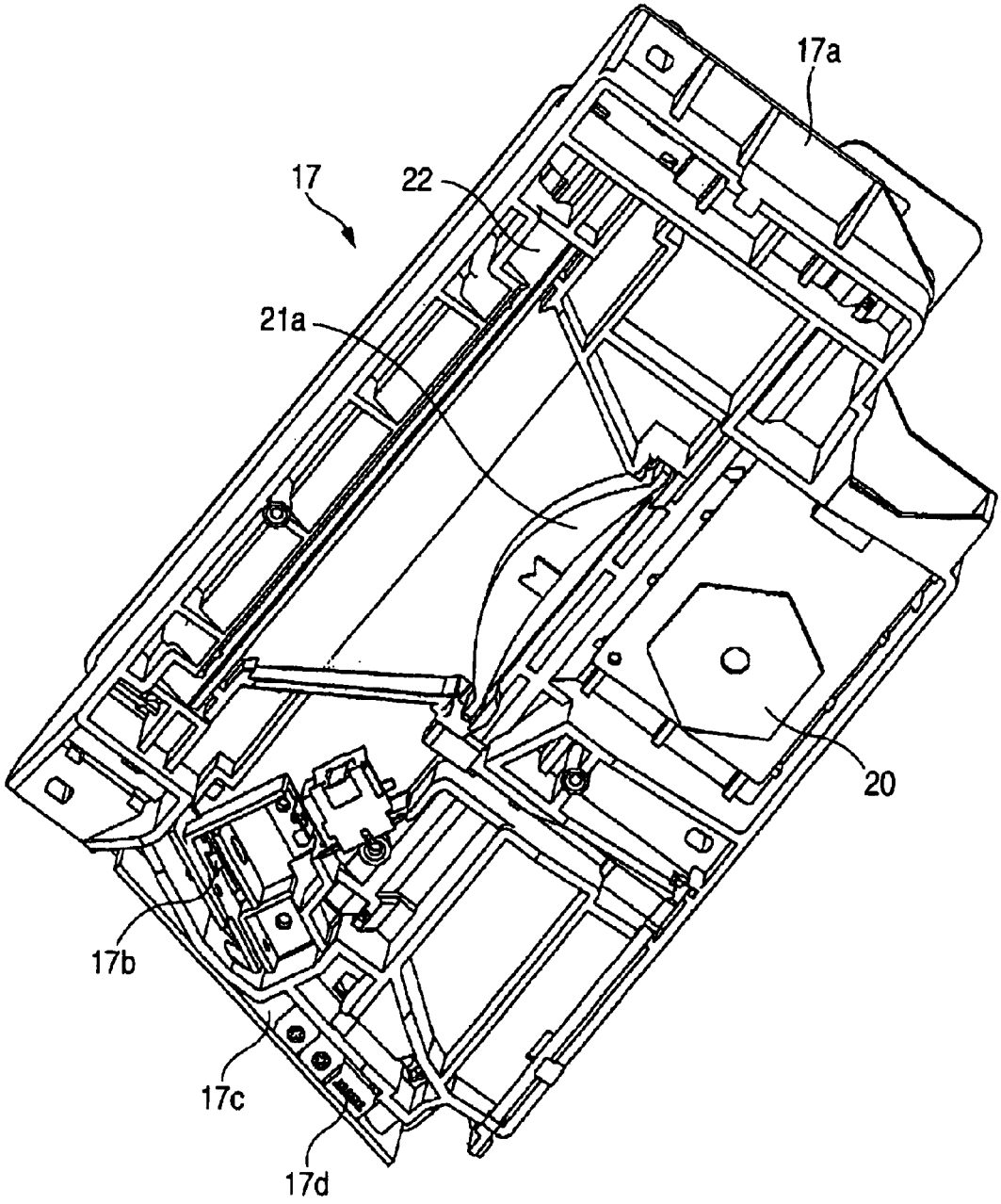
FIG. 8 is a perspective view showing a scanner unit viewed from the bottom thereof.
Figure 9:
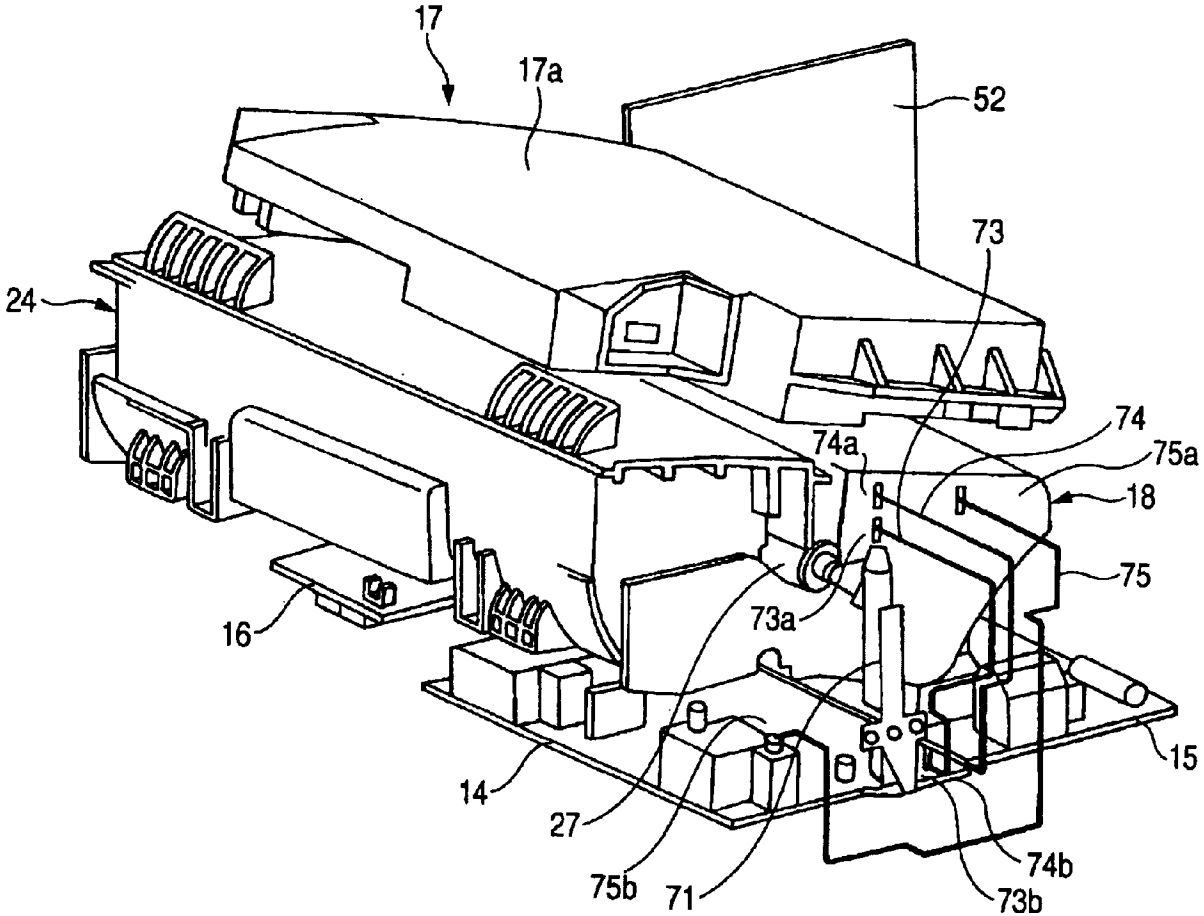
FIG. 9 is a perspective view showing a connection part of a process unit, etc., and a high voltage power board viewed from the same direction as that in FIG. 1.
Figure 10:
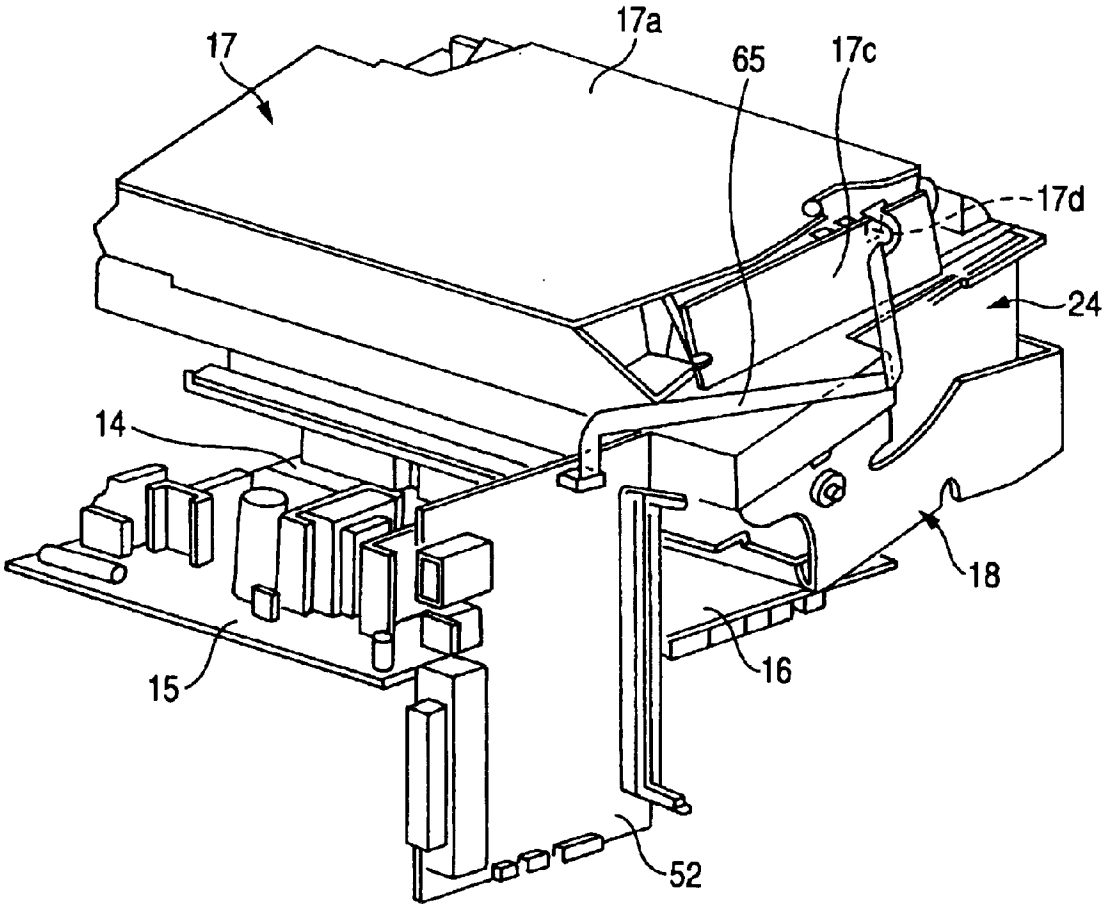
FIG. 10 is a perspective view showing a connection part of a process unit, etc., and a main control board viewed from the same direction as that in FIG. 1.
Figure 11:
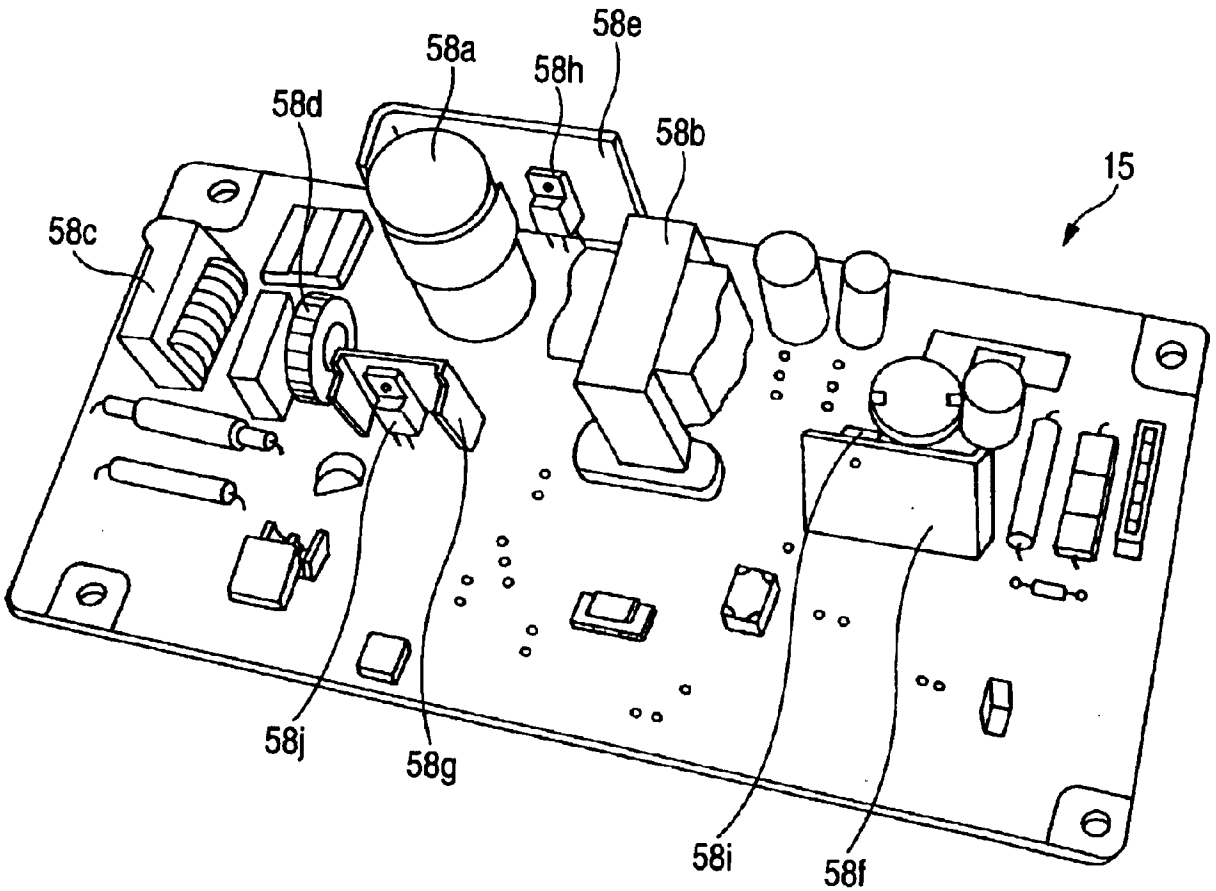
FIG. 11 is a perspective view showing an electronic parts mount side of a low voltage power board.
Figure 12:
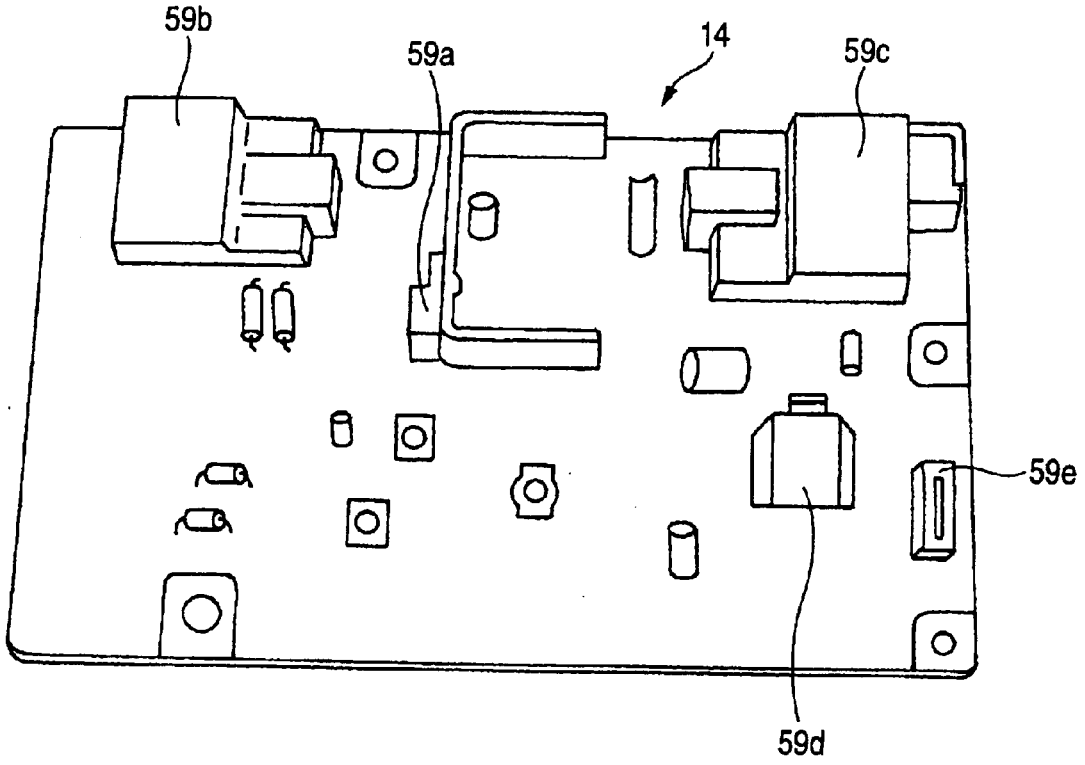
FIG. 12 is a perspective view showing an electronic parts mount side of the high voltage power board.
Figure 13:
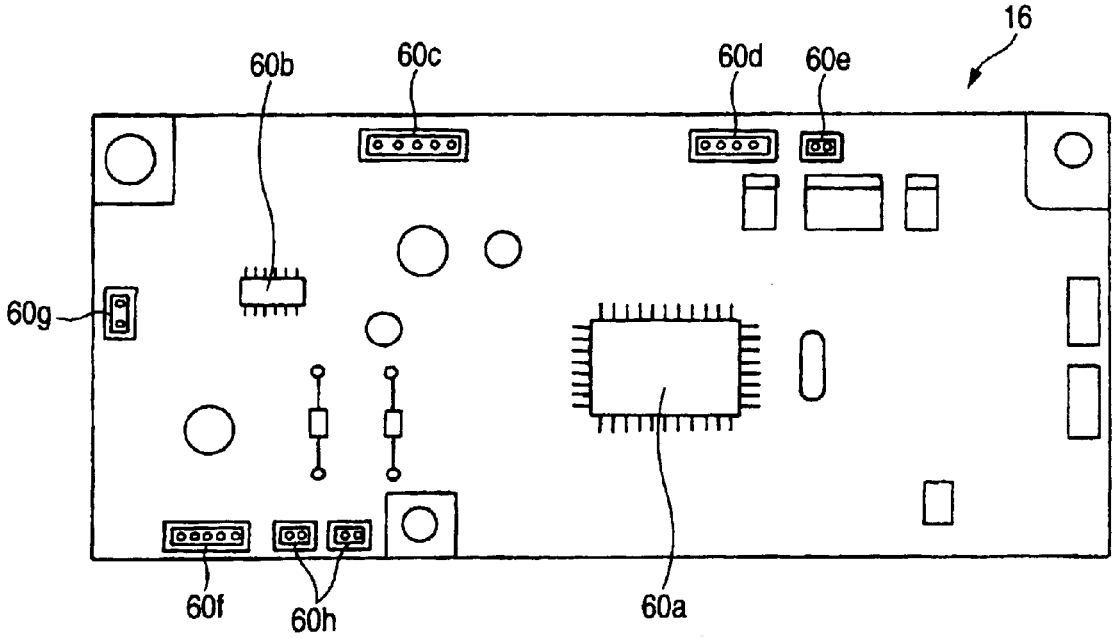
FIG. 13 is a plan view showing an engine control board.

The scanner unit 17 as an exposure unit is placed above the image forming unit (described later) on the lower face of the sheet discharging tray 36 of the top cover member 4*e* in the upper part of the body frame 2, as shown in FIGS. 2, 9, and 10. The scanner unit 17 includes a laser diode 17*b* placed in a scanner case 17*a* with the bottom open, a polygon mirror 20 being rotatably driven, a fθ lens 21*a*, a lens 21*b*, a reflecting mirror 22, etc., as shown in FIGS. 8, 9, and 10. Based on prepared image data, the scanner unit 17 allows a laser beam (light exposure signal) emitted from the laser diode 17*b* at a predetermined timing to pass through or be reflected on the polygon mirror 20, the fθ lens 21*a*, the reflecting mirror 22, and the lens 21*b* in order and scans the laser beam at high speed over the surface of the photosensitive drum 23 as one example of an electrostatic latent image support in the process unit 18.

The process unit 18 as a part of the image forming unit includes a drum cartridge having the photosensitive drum 23 as an electrostatic latent image support, a scorotron charger 37 as an charging unit, a transfer roller 25 as a transfer section, and a developing cartridge 24 that can be attached to and detached from the drum cartridge. The front cover 4*c* can be opened and closed. When the front cover 4*c* is open, the process unit 18 attached as shown in FIG. 2 can be taken out through the front side.

The developing cartridge 24 includes a toner storage section 26, a developing roller 27 as a developing section, a layer thickness regulation blade (not shown), a toner supply roller 29, etc.

The toner storage section 26 is filled with nonmagnetic mono component polymerized toner of positive charge property as a developer. The toner is supplied by the toner supply roller 29 to the developing roller 27. At this time, the toner is positively frictionally charged between the toner supply roller 29 and the developing roller 27. Further, the toner supplied onto the developing roller 27 is supported onto the developing roller 27 as a thin layer of a constant thickness by friction of the layer thickness regulation blade in accordance with rotation of the developing roller 27. On the other hand, the rotating photosensitive drum 23 is placed facing the developing roller 27 and has a drum main body grounded and the surface is formed with a positively charged photosensitive layer made of an organic photoconductor material such as polycarbonate.

The scorotron charger 37 as the charging section is disposed above the photosensitive drum 23 with a gap defined therebetween so as not to come in contact with the photosensitive drum 23. The scorotron charger 37 is a positive charging scorotron charger to generate corona discharge from a charging wire of tungsten, etc., and uniformly positively charges the surface of the photosensitive drum 23.

As the photosensitive drum 23 rotates, the surface of the photosensitive drum 23 is uniformly positively charged by the scorotron charger 37 and then a laser beam from the scanner unit 17 is scanned over the surface of the photosensitive drum 23 at high speed to expose the surface to light and an electrostatic latent image based on predetermined image data is formed on the surface of the photosensitive drum 23.

When the positively charged toner supported on the developing roller 27 is opposed to and comes in contact with the photosensitive drum 23 as the developing roller 27 rotates, the toner is supplied to the electrostatic latent image formed on the surface of the photosensitive drum 23, namely, the toner is selectively supported on the portion exposed to light by the laser beam and lowered in potential in the uniformly positively charged surface of the photosensitive drum 23, thereby rendering the electrostatic latent image visible as a toner image.

The transfer roller 25 is placed below the photosensitive drum 23 so as to be opposed to the photosensitive drum 23. The transfer roller 25 has a metal roller shaft covered with a roller made of an ionic conductive rubber material. During the transferring process, a transfer bias (transfer forward bias) is applied from a transfer bias application power supply to the transfer roller 25. Thus, the toner image supported on the surface of the photosensitive drum 23 is transferred to the sheet 3 while the sheet 3 passes through the nip between the photosensitive drum 23 and the transfer roller 25.

Subsequently, the configuration of the fixer 19 as the fixing unit will be discussed. The fixer 19 is disposed downstream in the transport direction from the process unit 18 and includes one heating roller 30, a pressurization roller 31 placed so as to press the heating roller 30, and a pair of transport rollers 32 disposed downstream from the rollers 30 and 31, as shown in FIG. 2. The heating roller 30 is made of metal of aluminum, etc., and includes a heater such as a halogen lamp for heating. It thermally fixes the toner transferred onto the sheet 3 in the process unit 18 while the sheet 3 passes through the nip between the heating roller 30 and the pressurization roller 31. The sheet 3 is then transported by the transport rollers 32 and is transported by a sheet discharge roller 35 in a sheet discharge path inside the rear cover member 4*d* in the body case K and is then discharged onto the sheet discharging tray 36.

In the embodiment, the laser printer includes a return section 40 for forming an image on both sides of the sheet 3. The sheet discharge roller 35 can be selectively rotated forward or reversely so as to serve as a reversal mechanism in the return section 40.

To conduct double-sided printing, the sheet 3 with an image formed on one side is transported by the transport rollers 32 to the sheet discharge roller 35 and is once stopped with the trailing end of the sheet 3 clamped in the part of the sheet discharge roller 35. Then, when the sheet discharge roller 35 is rotated reversely, the sheet 3 is delivered to an inner return path 41 in the rear cover member 4*d*.

The sheet 3 is then transported in the return direction R while a side edge of the sheet 3 is abutted against a reference plate (not shown) by skewed rollers 43*a*, 43*b*, etc., in the return path 41 on a return tray 42 placed detachably on the top of the sheet feed tray 6, on the lower face side of the bottom cover member 50. The sheet 3 is returned to another transport member 45 through a return guide plate 44. Accordingly, the sheet 3 is reversed so that the nonprint side of the sheet 3 is up at the part of the registration roller 12. Consequently, when the sheet 3 is passed through the image forming position in this state, an image can be formed on the other side (back) of the sheet 3.

A drive transmission system frame 51 made of a metal plate including a drive gear system for driving the rollers of the sheet feeding roller 9, the process unit 18, the developing cartridge 24, and the fixer 19 is attached in a longitudinal direction (substantially vertical direction) on the outer side of the left side frame part 2*b* (corresponding to a first side frame) in the body frame 2. The drive transmission system frame 51 extends from a side near to placement of the sheet feeding roller 9 (the front of the laser printer 1) to a side part of the fixer 19. A main control board 52 is attached at the rear of the drive transmission system frame 51, and a cord connection connector 53 connectable to an external machine and a power cord connector (not shown) are open at the rear end of the laser printer 1. (See FIG. 5.)

A cooling fan 54 for discharging heat generated in the fixer 19 to the outside of the body case K is placed on the upper side of the right side frame part 2*a* (corresponding to a second side frame) in the body frame 2, and a cooling fan 55 for discharging heat generated from a high voltage power board 14, a low voltage power board 15 and an engine control board 6 (described later) is placed on the lower side of the right side frame part 2*a*. The heat is discharged to the outside of the laser printer through exhaust ports 56 and 57 made in the right cover member 4*a* at the positions corresponding to the cooling fans 54 and 55. (See FIGS. 1 and 4.)

Subsequently, the layout of the main control board 52, the high voltage power board 14, the low voltage power board 15, and the engine control board 16 as the circuit boards for supplying power to the image forming apparatus and controlling the apparatus will be described in detail with reference to FIGS. 1 to 5.

The main control board 52 outputs a light exposure signal to the exposure unit in accordance with image data and also outputs control signals to the image forming unit and the exposure unit. To provide a printer function, the main control board 52 includes a control circuit for controlling the image forming apparatus so as to receive print data, a print command, etc., from an external apparatus such as a computer, and execute a print job based on the print command. The low voltage power board 15 drops commercial voltage (100 volts to 220 volts) supplied via a power cord (not shown) to a predetermined low voltage and supplies the low voltage to control circuit sections of the main control board 52, the high voltage power board 14, and the engine control board 16. The high voltage power board 14 generates a high voltage although it is a low current, and applies the high voltage to the charger 37, the photosensitive drum 23, etc., in the process unit 18. The engine control board 16 outputs a drive signal to the drive sources of the image forming unit and the exposure unit, for example, actuators (not shown) of a drive motor in the sheet feeder 5, or a solenoid of a one-rotation clutch in the sheet feeder 5, in accordance with a control signal from the main control board 52.

The main control board 52 is placed substantially vertically along the outer side of the left side frame part 2*b* (corresponding to the first side frame). (See FIGS. 7, 9, and 10.) The main control board 52 is placed substantially vertically on the side near to the side where the operation panel 4*f* is provided as shown in FIG. 6. In the case where the operation panel 4*f* and the main control board 52 are connected by a connection line (not shown), the connection line can be shortened. The main control board 52 and a connector 17*d* in a drive circuit board 17*c* of the laser diode 17*b* in the scanner unit 17 are connected by a connection line 65 such as a flat cable. (See FIGS. 8 and 10.) Since a high clock signal (high frequency signal) is sent from the main control board 52 to the connection line 65 accompanying a light exposure signal, noise easily occurs and the connection line 65 easily picks up noise. If noise is picked up, light emission of the laser diode 17*b* is adversely affected, leading to irregularity in an image. Therefore, by shortening the connection line 65; noise is prevented from occurring and irregularity in an image caused by noise is prevented from occurring.

The high voltage power board 14 and the low voltage power board 15 are, as shown in FIGS. 1 to 12, placed substantially horizontally with the board faces at the same height at a position near to the right side frame part 2*a* (second side frame) on the lower face side of the partition wall frame part 2*c* in the body frame 2. The high voltage power board 14 and the low voltage power board 15 are placed upward so that a plurality of electronic parts 58*a* to 58*d*, 58*h* to 58*j*, etc., mounted on the low voltage power board 15 and a plurality of electronic parts mounted on the high voltage power board 14 (a transistor 59*a* attached to a heat sink, transformers 59*b* to 59*d*, a connector 59*e*, etc.,) are directed in the direction of the partition wall frame part 2*c* (to the upper side of the body case K).

The engine control board 16 is, as shown in FIGS. 1 to 10 and 13, placed so that a plurality of short electronic parts 60 mounted on the board 16 (a gate array 60*a*, a comparator 60*b*, terminals 60*c* to 60*h* for connecting connection lines of harness, etc., and the like) are directed downward in the body case K. To assemble, the boards 14, 15, and 16 are placed from the bottom side of the body frame 2 (the upper side in FIGS. 4 and 5) with the body frame 2 turned upside down, as shown in FIGS. 4 and 5. Electronic parts 58 are mounted on the low voltage power control board. The electronic parts mounted on the low voltage power board 15 include a bulky, large electrolytic capacitor 58*a*, a transformer 58*b* and a choke coil 58*c*. Also mounted on the board 15 are an FET 58*h*, a low voltage IC 58*i* and a triac 58*j*, which are attached to tall heat sinks (cooling palates) 58*e* to 58*g*. These parts are large parts taller than the electronic parts 60*a* to 60*h* mounted on the engine control board 16. The electronic part 58*a* to 58*d* and 58*h* to 58*j* and the heat sinks 58*e* to 58*g* for dissipating heat generated from the electronic parts are placed in a space 62 defined by an upward projection of the partition wall frame part 2*c* (see FIGS. 2 and 3).

Figure 7:
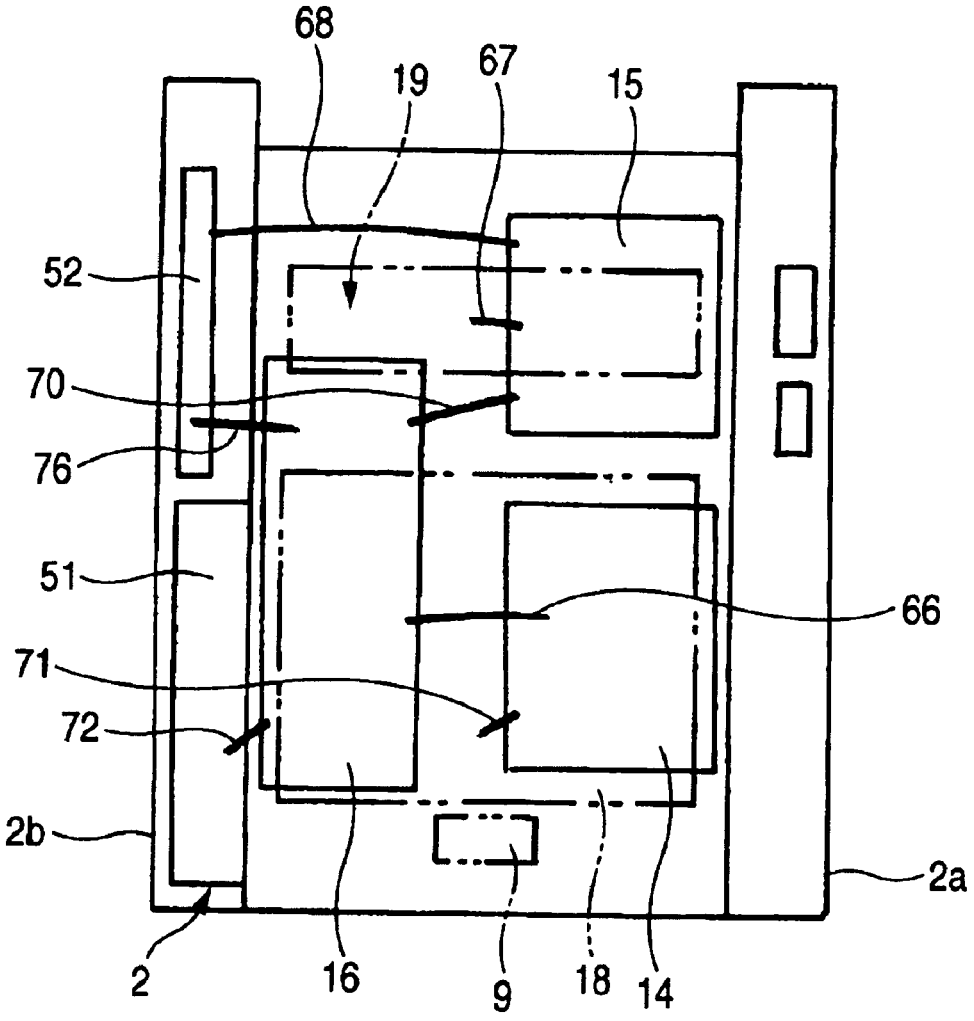
FIG. 7 is a plan view showing a schematic layout of the body frame, boards, etc.

As shown in FIGS. 7 and 9, connection is made from the low voltage power board 15 to the heater (not shown) in the fixer 19, the high voltage power board 14, the main control board 52, and the engine control board 16 via connection lines 67, 68, and 70 for supplying power.

The high voltage power board 14 and the engine control board 16 are connected via a connection line 66. Further, connection is made from the high voltage power board 14 to the developing roller 27 in the developing cartridge 24 via a connection line 71 for giving a developing bias, and connection is made from the high voltage power board 14 to a grid electrode and the charging wire in the charger 37 of the process unit 18 via wire-like connection lines 73 and 74 for giving a grid bias and a charging bias. (See FIG. 9.) The high voltage power board 14 and a cleaning brush of the process unit 18 are also connected via a wire-like connection line 75 for giving a cleaning bias.

That is, cartridge side contacts 73*a*, 74*a* and 75*a* to which biases are applied are provided on a right side frame part side of the process cartridge, and body side contacts 73*b*, 74*b* and 75*b* connected to the cartridge side contacts 73*a*, 74*a* and 75*a* and connected to the high voltage power board 14 are provided on a body side.

The high voltage power board 14 is positioned close to the right side frame part 2*a* and close to the depth of the body frame 2 and is positioned adjacent to other boards 52, 15, and 16 and therefore the connection lines 65 to 70 are shortened. Since the high voltage power board 14 is placed below the process unit 18, when the connection lines 73 to 75 from the high voltage power board 14 are connected to the charger 37, the photosensitive drum 23, etc., the lengths of the lines can be shortened.

Connection is made from the engine control board 16 to the main control board 52 via a connection line 76, and connection is made from the engine control board 16 via a connection line 72 for supplying power to the drive motor and the solenoid. Since the engine control board 16 and the main control board 52 are placed close to the left side frame part 2*b* and near to placement of the drive transmission system frame 51, the connection lines 76 and 72 can also be shortened.

Thus, the high voltage power board 14, the low voltage power board 15, and the engine control board 16 are placed horizontally on the lower face side of the partition wall frame part 2*c* of the body frame 2. The high voltage power board 14 is placed on the side near to the right side frame part 2*a*. The main control board 52 and the drive transmission system frame 51 are placed in the longitudinal direction so that they are contiguous to each other along the outer face of the left side frame part 2*b*. The engine control board 16 is placed on the side near to the left side frame part 2*b* and on the side near to the drive transmission system frame 51. Therefore, the four boards 52, 14, 15, and 16 can be brought close to each other in their placement for making the body frame 2 compact in size.

The engine control board 16 is placed with the electronic parts mount side thereof directed downward (directed in the bottom direction of the body frame 2), so that a worker can see the electronic parts 60*a* to 60*h* and the connection line 72 to the drive motor and the solenoid. (See FIG. 4.) When placing the bottom cover member 50 as described later in this state, the worker can check the arrangement of the connection line 72 and then place the bottom cover member 50 so that the connection line 72 does not get caught in the gap between the bottom cover member 50 and the electronic parts 60*a* to 60*h*.

The high voltage power board 14 and the low voltage power board 15 on which the electronic parts 58*a* to 58*d*, 58*h* to 58*j*, and 59*a* to 59*e* are mounted so as to be directed in the upper direction of the body frame 2 are placed to one side of the body frame 2, and the engine control board 16 with the electronic parts 60*a* to 60*h* directed in the bottom direction of the body frame 2 is placed to an opposite side of the body frame 2. The boards 14 and 15 and the engine control board 16 are placed at different levels. The height positions of the boards 14 and 15 are near to the bottom of the body frame 2. The height position of the engine control board 16 is higher than the height positions of the boards 14 and 15, but still near to the bottom of the body frame 2.

The board height position of the engine control board 16 with the electronic parts 60*a* to 60*h* directed in the bottom direction of the body frame 2 is set to a higher position, whereby when placing the bottom cover member 50, the worker can bring the bottom cover member 50 close to the board height position of the engine control board 16 so that the connection line 71 does not get caught in the gap between the bottom cover member 50 and the electronic parts 60*a* to 60*h*. Therefore, it becomes unnecessary to define a useless vertical space between the partition wall frame part 2*c* and the bottom cover member 50, and it is made possible to decrease the height of the body frame 2 and the whole height of the laser printer 1.

With all boards 14 to 16 placed horizontally, an electric insulating film (not shown) is put from the bottom of the body frame 2 and the bottom cover body 50 is then put and fastened to a boss part projecting downward (directed to the bottom) from the lower face of the partition wall frame part 2*c* of the body frame 2 by a plurality of screws 63. The bottom cover member 50 and the boards 14 to 16 are fastened together by the screws 63, whereby the assembly work can be simplified as compared with the case where the boards are once fixed by different screws and then the bottom cover member is screwed.

Since the high voltage power board 14 and the low voltage power board 15 positioned to one side and the engine control board 16 positioned to an opposite side are placed at different levels, the bottom cover member 50 is formed into a step shape having the different levels. (See FIG. 4.)

A high different-level part 50*a* of the bottom cover member 50 (corresponding to the place of the engine control board 16) can provide a large vertical space with the return tray 42 placed on the upper face of the sheet feed tray 6. The skewed rollers 43*a*, 43*b* may be placed in th different-level part, to thereby decrease the height of the body frame 2 and the whole height of the body frame 2 and the whole height of the laser printer 1.

The space between the bottom cover member 50 and the partition wall frame part 2*c* is made to communicate with a substantially horizontal air suction path of the cooling fan 55, so that it is made possible to smoothly discharge heat generated from the boards 14 to 16 placed horizontally.

Figure 14:
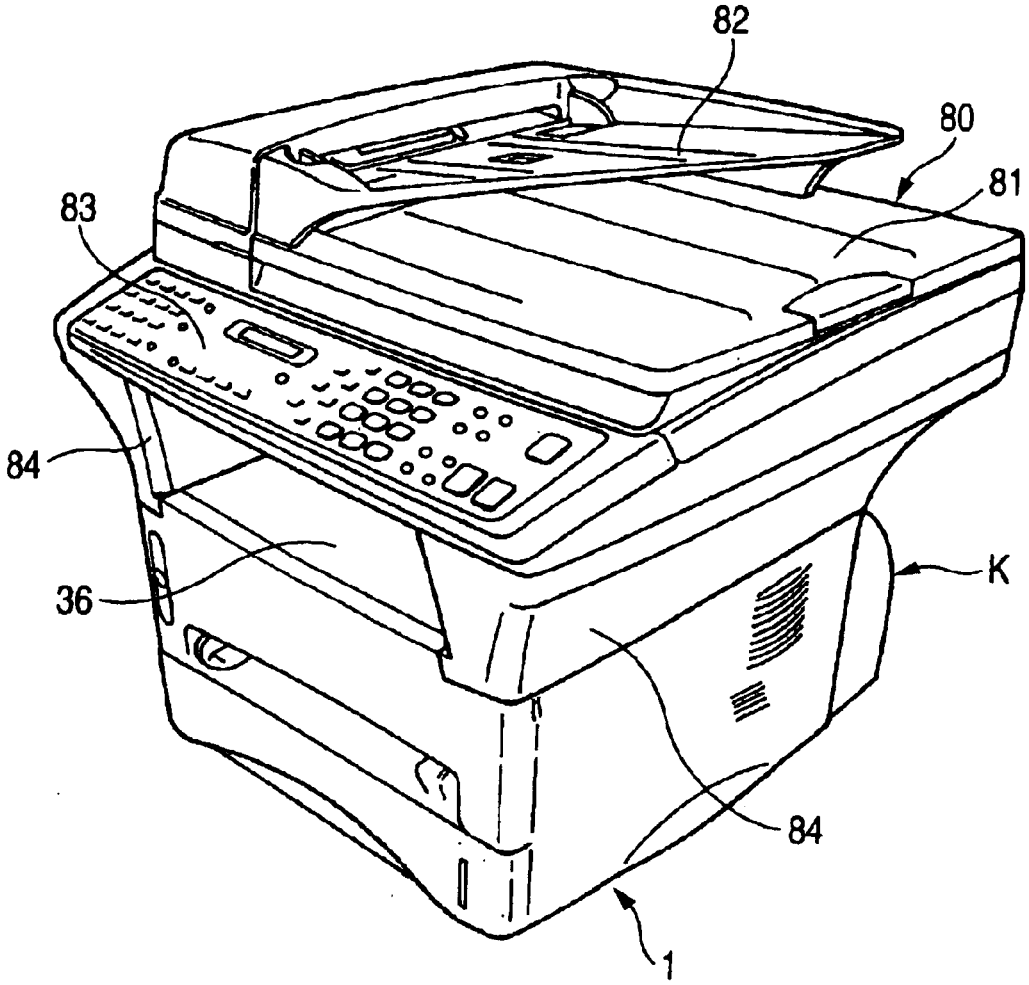
FIG. 14 is a perspective view of a complex machine including an image reader placed on and joined to the top of the image forming apparatus.

As shown in FIG. 14, an image reader 80 including an original placement section shaped like a flat glass plate, press cover member 81 and an original auto-feeder 82 for a copy function, a line CCD image sensor (not shown) for a scanner function, and a circuit board (not shown) and an operation panel section 83 for a facsimile function may be placed on and joined to the top of the body case K of the image forming apparatus 1 having a printer function via foot parts 84 and 84 to constitute a complex image forming apparatus having complex functions. In this case, if the line CCD image sensor is placed in an upper part on the side near to the main control board 52 and a flat connection line therefrom is connected to the main control board 52, the flat connection line can also be shortened and a feeble read signal can be prevented from being disturbed by the electromagnetic wave from any other connection line or the board 14, 15, 16 or picking up noise is prevented.

Such a configuration is applied to a laser printer, an ink jet printer, or a multifunctional image forming apparatus including a facsimile function, whereby the height dimension of the image forming apparatus can be decreased in size.

As was described above, in an image forming apparatus according to a first aspect of the invention, a image forming unit is placed between a first side frame and a second side frame as a pair of left and right frames extending in a substantially vertical direction; an exposure unit is placed above the image forming unit; a main control board for outputting control signals to the image forming unit and the exposure unit is placed substantially vertically on the side of the first side frame; a power board is placed substantially horizontally below the image forming unit on the side of the second side frame; and an engine control board for outputting a drive signal to drive sources of the image forming unit and the exposure unit in accordance with a control signal from the main control board is placed substantially horizontally below the image forming unit closer to the first side frame than the power board. Thus, the body frame can be made compact in size and the connection lines to the boards or the machines of the drive sources, etc., can also be shortened. Particularly, the main control board is placed substantially vertically and thus the connection line between the exposure unit driven at a high frequency and the main control board can be shortened and noise can be prevented from occurring and irregularity in an image caused by noise can be prevented.

In the image forming apparatus according to a second aspect of the invention, an operation panel is placed above the image forming unit and is connected to the main control board placed substantially vertically. Thus, the connection line connecting the operation panel and the main control board can be more shortened and the apparatus body can be made compact in size.

In the image forming apparatus according to a third aspect of the invention, the power board includes a low voltage power board being connectable to a commercial power supply for outputting a predetermined voltage and a high voltage power board for applying various biases to the image forming unit. Thus, the layout of the boards when the apparatus is made compact in size can be facilitated.

In the image forming apparatus according to a fourth aspect of the invention, a body side contact for connecting to a detachable process cartridge is provided on a second side frame side of an apparatus body and is connected to the high voltage power board placed on the side of the second side frame, so that the connection line between the body side contact and the high voltage power board can be shortened.

In the image forming apparatus according to a fifth aspect of the invention, a fixing unit for thermally fixing an image transferred to a recording medium is placed downstream in a recording medium transport direction from the image forming unit and the high voltage power board is placed upstream in the recording medium transport direction from the low voltage power board. Thus, the image forming unit and the high voltage power board are placed together upstream in the recording medium transport direction and the connection line connecting the image forming unit and the high voltage power board can be shortened.

In the image forming apparatus according to a sixth aspect of the invention, the low voltage power board supplies power to a heater of the fixing unit placed downstream in the recording medium transport direction from the high voltage power board, so that the connection line connecting the low voltage power board and the heater of the fixing unit can be shortened.

In the image forming apparatus according to a seventh aspect of the invention, the high voltage power board is placed at a front side in the image forming apparatus, the low voltage power board is placed at a rear side in the image forming apparatus, and the process cartridge is attached to and detached from the image forming apparatus through a front side of the image forming apparatus. Thus, the process cartridge can be easily attached and detached and the connection line between the boards and the connection line to the image forming unit can also be shortened.

In the image forming apparatus according to an eighth aspect of the invention, a space is defined behind the low voltage power board and a part of a return path for guiding a recording medium with an image formed on one side from the upper side of the low voltage power board to the lower side and returning the recording medium to the image forming unit is formed in the space. Thus, a compact apparatus capable of performing double-sided printing can be manufactured.

In the image forming apparatus according to a ninth aspect of the invention, a sheet feed tray on which recording mediums are stacked is placed detachably through the front side of the image forming apparatus, below the power board and the main control board. Thus, the sheet feed tray can be easily attached and detached and the apparatus body can be made compact in size.

In the image forming apparatus according to a tenth aspect of the invention, a reader is placed on the top of the image forming apparatus and is connected to the main control board. Thus, the connection line connecting the reader and the main control board can be more shortened, assembling is facilitated, and the apparatus becomes compact in size. A feeble read signal in the reader can be prevented from picking up noise generated by the electromagnetic wave from any other connection line or any board placed in the lower part of the body, thereby irregularity in a read signal can be prevented.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

first and second side frames as a pair of left and right frames extending in a substantially vertical direction;

an image forming unit disposed between the first and second side frames for developing an electrostatic latent image formed on an electrostatic latent image support, transferring the latent image to a recording medium, and forming an image on the recording medium;

an exposure unit disposed above the image forming unit for exposing the electrostatic latent image support to light for forming an electrostatic latent image;

a main control board placed substantially vertically on the side of the first side frame for outputting a light exposure signal to the exposure unit in accordance with image data and outputting control signals to the image forming unit and the exposure unit;

a power board placed substantially horizontally below the image forming unit on the side of the second side frame; and an engine control board placed substantially horizontally below the image forming unit for outputting a drive signal to drive sources of the image forming unit and the exposure unit in accordance with a control signal from the main control board, the engine control board placed closer to the first side frame than the power board.

2. The image forming apparatus as claimed in claim 1, further comprising an operation panel placed above the image forming unit and connected to the main control board.

3. The image forming apparatus as claimed in claim 1, wherein the power board comprises:

a low voltage power board being connectable to a commercial power supply to output a predetermined voltage; and a high voltage power board for applying various biases to the image forming unit.

4. The image forming apparatus as claimed in claim 3, wherein the image forming unit comprises a process cartridge detachably disposed between the first and second side frames, a cartridge side contact to which a bias is applied is provided on a second side frame side of the process cartridge, and a body side contact connected to the cartridge side contact and connected to the high voltage power board is provided on a second side frame side of an apparatus body.

5. The image forming apparatus as claimed in claim 3, wherein a fixing unit for thermally fixing an image transferred to a recording medium is placed downstream in a recording medium transport direction from the image forming unit, and the high voltage power board is placed upstream in the recording medium transport direction from the low voltage power board.

6. The image forming apparatus as claimed in claim 5, wherein the low voltage power board supplies power to a heater disposed in the fixing unit.

7. The image forming apparatus as claimed in claim 5, further comprising a front cover provided at a front side of the image forming apparatus, wherein the high voltage power board is placed at the front side in the image forming apparatus, the low voltage power board is placed at a rear side opposite to the front side in the image forming apparatus, and the process cartridge is attached to and detached from the image forming apparatus through the front side of the image forming apparatus when the front cover is open.

8. The image forming apparatus as claimed in claim 7, wherein a space is defined behind the low voltage power board and a part of a return path for guiding a recording medium with an image formed on one side from the upper side of the low voltage power board to the lower side and returning the recording medium to the image forming unit is formed in the space.

9. The image forming apparatus as claimed in claim 1, wherein a sheet feed tray on which recording mediums are stacked is detachably placed through a front side of the image forming apparatus, and the sheet feed tray is placed below the power board and the main control board.

10. The image forming apparatus as claimed in claim 1, further comprising a reader placed on the top of the image forming apparatus and connected to the main control board.

* * * * *